US009239586B2

(12) United States Patent
Huang

(10) Patent No.: US 9,239,586 B2
(45) Date of Patent: Jan. 19, 2016

(54) LEAKAGE-CURRENT START-UP REFERENCE CIRCUIT

(71) Applicant: Industrial Technology Research Institute, Hsinchu (TW)

(72) Inventor: Chao-Jen Huang, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 20 days.

(21) Appl. No.: 14/286,831

(22) Filed: May 23, 2014

(65) Prior Publication Data

US 2015/0153758 A1 Jun. 4, 2015

Related U.S. Application Data

(60) Provisional application No. 61/911,705, filed on Dec. 4, 2013.

(51) Int. Cl.

| | |
|---|---|
| ***G05F 1/10*** | (2006.01) |
| ***G05F 3/16*** | (2006.01) |
| ***G05F 3/26*** | (2006.01) |

(52) U.S. Cl.

CPC . *G05F 3/16* (2013.01); *G05F 3/262* (2013.01)

(58) Field of Classification Search

CPC ..... G05F 3/16
USPC ..... 327/542
See application file for complete search history.

(56) References Cited

U.S. PATENT DOCUMENTS

| | | | |
|---|---|---|---|
| 7,551,021 | B2 | 6/2009 | Florescu |
| 7,705,656 | B2 | 4/2010 | Jung |

(Continued)

FOREIGN PATENT DOCUMENTS

| | | | |
|---|---|---|---|
| CN | 101841967 | A | 9/2010 |
| CN | 102157926 | A | 8/2011 |

(Continued)

OTHER PUBLICATIONS

Ruixing, Li, et al., Bitline Leakage Current Compensation circuit for high-performance SRAM Design, *IEEE Seventh International Conference on Networking, Architecture, and Storage*, Jun. 2012, pp. 109-113.

(Continued)

*Primary Examiner* — Daniel Puentes
(74) *Attorney, Agent, or Firm* — Muncy, Geissler, Olds & Lowe, P.C.

(57) ABSTRACT

A leakage-current start-up reference circuit is provided which includes a reference circuit unit, a trigger unit, a leakage-current generator and a disable control unit. The trigger unit includes a first transistor. The drain terminal of the trigger unit is connected to a start-up terminal of the reference circuit unit. The leakage-current generator includes a second transistor which is a gate-drain-tied transistor. The disable control unit includes a third transistor. The gate terminal of the disable control unit is connected to a control terminal of the reference circuit unit. The drain terminal of the leakage-current generator, the gate terminal of the trigger unit and the drain terminal of the disable control unit are joined at a node. The reference circuit unit is started up by the trigger unit to generate a reference current. A leakage-current start-up reference circuit having a current mirror is also provided.

18 Claims, 3 Drawing Sheets

(56) References Cited

U.S. PATENT DOCUMENTS

| | | | | |
|---|---|---|---|---|
| 7,940,577 | B2 | 5/2011 | Shimogawa et al. | |
| 7,944,267 | B2 | 5/2011 | Jung | |
| 2014/0118034 | A1* | 5/2014 | Lemkin et al. | 327/143 |

FOREIGN PATENT DOCUMENTS

| | | | |
|---|---|---|---|
| TW | I241671 | B | 10/2005 |
| TW | I273606 | B | 2/2007 |
| TW | 200719582 | | 5/2007 |
| TW | I299792 | B | 8/2008 |
| TW | I302205 | B | 10/2008 |
| TW | I357214 | B | 1/2012 |
| TW | 201212206 | A | 3/2012 |
| TW | M442648 | U | 12/2012 |
| TW | M450141 | U | 4/2013 |
| TW | M458019 | U | 7/2013 |

OTHER PUBLICATIONS

Choi, Byoungseon et al., Improvement of drain leakage current characteristics in metal-oxide-semiconductor-field-effect-transistor by asymmetric source-drain structure, *IEEE International Meeting for Future of Electron Devices Kansai(IMFEDK)*, May 2012, pp. 1-2.

Li Hua-Song and Kang Wen-Ziong, Artifical Intelligence tracing of Inherence leakage current between power line and earth, *International Conference on Artificial Intelligence and Computational Intelligence (AICI)*, Oct. 2010, pp. 272-275.

Wang, Taihui et al., Voltage Scaling and Temperature Effects on Drain Leakage Current Degradation in a Hot Carrier Stressed n-MOSFET, *IEEE International Reliability Physics Symposium Proceedings*, Apr. 1998, pp. 209-212.

Hsu, Steven., Self-Calibrating Circuit Design for Variation tolerant VLSI systems, *IEEE International On-line Testing Symposium*, Jul. 2005, pp. 100-105.

Abdollahi, A., Leakage Current Reduction in CMOS VLSI Circuits by Input Vector Control, *IEEE Transactions on Very Large Scale Integration (VLSI) Systems*, 2004, vol. 12, No. 2, pp. 140-154.

* cited by examiner

LEAKAGE-CURRENT START-UP REFERENCE CIRCUIT

CROSS-REFERENCE TO RELATED APPLICATION

The application is based on, and claims priority from, U.S. Provisional Application Ser. No. 61/911,705, filed on Dec. 4, 2013, of which the disclosure is hereby incorporated by reference herein in its entirety.

TECHNICAL FIELD

The technical field relates to integrated circuit design technology, and more specifically to leakage-current circuit design technology.

BACKGROUND

Nowadays, low-power circuit design has become more and more attractive due to an energy revolution. Many energy-saving technologies, such as the low voltage technology, dynamic voltage switching, subthreshold operating region design and so forth, have been proposed.

Moreover, energy harvesting also plays an important role in the environment. Energy harvesting has the potential to replace batteries for small and low-power electronic devices. That is to say, the energy harvesting technology is able to provide a very small amount of power for low-energy electronics. This has several benefits, such as maintenance free, environmentally friendly and opening up new application.

Further, energy harvesting devices may convert ambient energy into electrical energy, and have attracted much interest in the commercial sector. Some energy harvesting systems convert motion into electricity to be used by oceanographic monitoring sensors for autonomous operation. Future applications are in wearable electronics, where energy harvesting devices can recharge or power cellphones, mobile computers, radio communication equipment, etc. All of these devices must be sufficiently robust to endure long-term exposure to hostile environments.

As such, for the sake of meeting the requirements of the small chip area, low cost and extraordinarily low power, it is necessary to design an integrated miniaturize circuit capable of providing extremely low power in terms of the cost effectiveness, uncomplicated structure, compact design and versatility when used with relatively low supply voltages.

SUMMARY

The disclosure provides a leakage-current start-up reference circuit. According to an exemplary embodiment of the disclosure, the leakage-current start-up reference circuit includes a reference circuit unit, a trigger unit, a leakage-current generator and a disable control unit. The reference circuit unit has a start-up terminal and a control terminal. The trigger unit includes a first transistor. The drain terminal of the trigger unit is connected to the start-up terminal of the reference circuit unit. The leakage-current generator includes a second transistor which is a gate-drain-tied transistor. The disable control unit includes a third transistor. The drain terminal of the leakage-current generator, the gate terminal of the trigger unit and the drain terminal of the disable control unit are joined at a node.

In the exemplary embodiment of the disclosure, the disable control unit is turned on by a control terminal of the reference circuit unit, and the trigger unit is turned off after the reference circuit unit is started up. As a result, the reference circuit unit generates a reference current, and provides the reference for a next-stage circuit.

In another exemplary embodiment of the disclosure, the disclosure further discloses a leakage-current start-up reference circuit having a current mirror. The leakage-current start-up reference circuit includes a reference circuit unit, a trigger unit, a leakage-current generator, a disable control unit and a current mirror. The reference circuit unit has a start-up terminal and a control terminal. The trigger unit includes a first transistor. The drain terminal of the trigger unit is connected to the start-up terminal of the reference circuit unit. The leakage circuit generator includes a second transistor which is a gate-drain-tied transistor. The disable control unit includes a third transistor. Additionally, the current mirror has a reference terminal and an output terminal. The reference terminal is connected to the drain terminal of the leakage-current generator. The output terminal, the gate terminal of the trigger unit and the drain terminal of the disable control unit are joined at a node.

According to another exemplary embodiment of the disclosure, the disable control unit is turned on by a control terminal of the reference circuit unit, and the trigger unit is turned off after the reference circuit unit is started up. As a result, the reference circuit unit generates a reference current or a reference voltage, and provides the reference current or a reference voltage for a next-stage circuit.

Several exemplary embodiments accompanied with drawings are described in detail below in order to make the aforesaid and other features and advantages of the disclosure comprehensible.

BRIEF DESCRIPTION OF DRAWINGS

The disclosure can be more fully understood by reading the following detailed description of the preferred embodiments/examples, with references made to the accompanying drawings, wherein.

DETAILED DESCRIPTION

Figure 1:
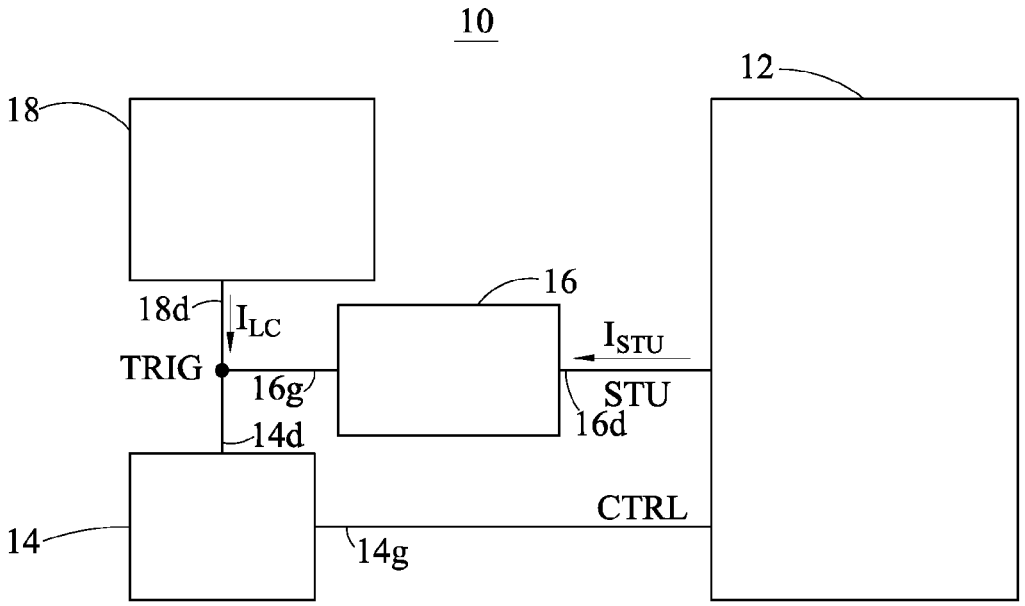
FIG. 1 is a block diagram illustrating a leakage-current start-up reference circuit in accordance with an exemplary embodiment of the disclosure.

The following embodiments are described in sufficient detail to enable those skilled in the art to make and use the disclosure. It is to be understood that other embodiments would be evident based on the disclosure, and that systemic, electrical or mechanical changes may be made without departing from the scope of the disclosure.

In the following description, numerous specific details are given to provide a thorough understanding of the disclosure. However, it will be apparent that the disclosure may be practiced without these specific details. In order to avoid obscuring the disclosure, some well-known mechanisms and configurations are not disclosed in detail.

The drawings showing embodiments of the architecture are semi-diagrammatic and not to scale and, particularly, some of the dimensions are for clarity of presentation and are shown exaggerated in the drawings. Similarly, although the views in the drawings for ease of description generally show similar orientations, this depiction in the drawings is arbitrary for the most part. Generally, the disclosure can be operated in any orientation.

The disclosure is described by the following embodiments and examples. Those with ordinary skills in the arts can readily understand the other functions of the disclosure after reading the disclosure of this specification. The disclosure can also be implemented with different embodiments and examples. Various details described in this specification can be modified based on different viewpoints and applications without departing from the scope of the disclosure.

FIG. 1 illustrates a block diagram of an exemplary embodiment of a leakage-current start-up reference circuit 10. Referring to FIG. 1, the leakage-current start-up reference circuit 10 may include a reference circuit unit 12, a disable control unit 14, a trigger unit 16 and a leakage-current generator 18.

According to an exemplary embodiment of the disclosure, the reference circuit unit 12 may have two terminals STU and CTRL, as shown in FIG. 1. In the exemplary embodiment of the disclosure, the reference circuit unit 12 may be a reference voltage circuit, a reference current circuit, a bandgap reference circuit unit, a bias current circuit or the like.

As shown in FIG. 1, the reference circuit unit 12 is not started up in the beginning. The control terminal CTRL of the reference circuit unit 12 is connected to a gate terminal 14*g* of the disable control unit 14. The control terminal CTRL of the reference circuit unit 12 may provide a voltage below the threshold voltage for the gate terminal 14*g* of the disable control unit 14. When the gate terminal 14*g* of the disable control unit 14 is below the threshold voltage, the disable control unit 14 is off.

Moreover, a drain terminal 18*d* of the leakage-current generator 18, a gate terminal 16*g* of the trigger unit 16 and a drain terminal 14*d* of the disable control unit 14 are joined at a node TRIG, as shown in FIG. 1. The leakage-current generator 18 provides a leakage-current for the disable control unit 14. As such, the leakage-current charges stray capacitance (not shown) of the disable control unit 14 while the disable control unit 14 is in the cutoff mode.

As shown in FIG. 1, a drain terminal 16*d* of the trigger unit 16 is connected to a start-up terminal STU of the reference circuit unit 12. The trigger unit 16 is enabled while a voltage across stray capacitance (not shown) of the disable control unit 14 is more positive and greater than the threshold voltage at the node TRIG. In other words, with the voltage at the node TRIG established, the trigger unit 16 provides a path for a current to flow through the trigger unit 16 into the ground. As such, a start-up current $I_{STU}$ flows through the trigger unit 16, such that the reference circuit unit 12 is enabled to generate a reference current and provide the reference current for a next-stage circuit.

When the voltage at the control terminal CTRL of the reference circuit unit 12 is getting more positive and greater than the threshold voltage, the disable control unit 14 is on, as shown in FIG. 1. Accordingly, the leakage-current $I_{LC}$ flows through the disable control unit 14 into the ground. That is to say, when the voltage at the node TRIG has been pulled below the threshold voltage, the trigger unit 16 is in the cutoff mode. Therefore, the trigger unit 16 is disabled while the voltage at the node TRIG is below the threshold voltage. On this occasion, the start-up current $I_{STU}$ stops flowing through the trigger unit 16.

Upon the aforesaid operation, the leakage-current generated by the leakage-current generator 18 is able to start up the reference circuit unit 12 in order to generate a reference current for the next-stage circuit when used with relatively low supply voltages. Therefore, the resulting leakage-current start-up reference circuit 10 of the disclosure is power-saving, cost-effective, uncomplicated, highly versatile and effective, and can be implemented by adopting known semiconductor technology for efficient and economical manufacturing, application and utilization.

In the exemplary embodiment of the disclosure, the leakage-current start-up reference circuit 10 generating a reference current is supply-voltage independent using the leakage-current technology.

Further, the leakage-current start-up reference circuit 10 of the disclosure is capable of generating a reference current when used with relatively low supply voltages.

Figure 2:
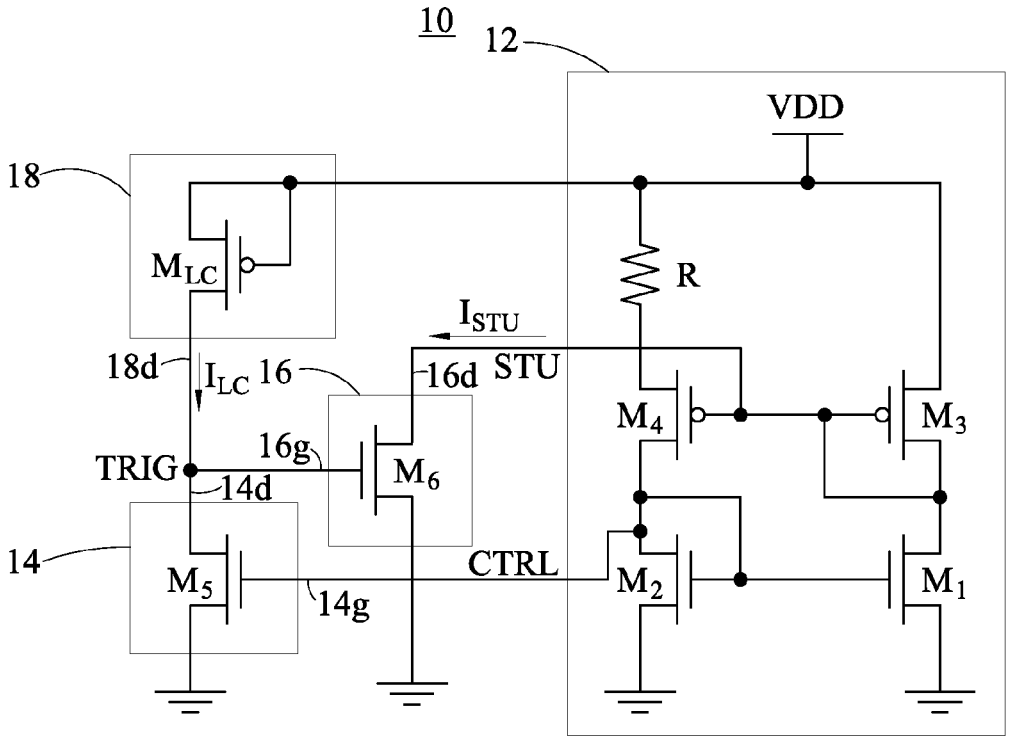
FIG. 2 is a circuit schematic diagram illustrating the leakage-current start-up reference circuit in accordance with an exemplary embodiment of the disclosure.

Referring to FIG. 2, a circuit schematic diagram of the leakage-current start-up reference circuit 10 is illustrated in accordance with the exemplary embodiment of the disclosure. The leakage-current start-up reference circuit 10 may include a reference circuit unit 12, a disable control unit 14, a trigger unit 16 and a leakage-current generator 18.

According to the exemplary embodiment of the disclosure, the reference circuit unit 12 having two terminals STU and CTRL may include a plurality of transistors M1, M2, M3, M4, as shown in FIG. 2. Additionally, the reference circuit unit 12 may be a reference voltage circuit, a reference current circuit, a bandgap reference circuit unit, a bias current circuit or the like.

In operation, the trigger unit 16 may include a transistor M6. Moreover, the trigger unit 16 may include digital electronics, such as digital NAND, NOR and NOT circuits. The leakage-current generator 18 may include a gate-drain-tied transistor $M_{LC}$. Also, the disable control unit 14 may include a transistor M5. As shown in FIG. 2, all the transistors used in the disclosure may be MOSFETs and the like.

As shown in FIG. 2, initially, the reference circuit unit 12 is not started up. The control terminal CTRL of the reference circuit unit 12 is connected to a gate terminal 14*g* of the transistor M5 of the disable control unit 14. The control terminal CTRL of the reference circuit unit 12 may provide a voltage below the threshold voltage for the gate terminal 14*g* of the transistor M5 of the disable control unit 14. When the gate terminal 14*g* of the transistor M5 of the disable control unit 14 is below the threshold voltage for making a conductive channel, there is little or no conduction between the drain and source terminals; that is, the disable control unit 14 is off.

Moreover, a drain terminal 18*d* of the gate-drain-tied transistor $M_{LC}$, a gate terminal 16*g* of the transistor M6 of the trigger unit 16 and a drain terminal 14*d* of the transistor M5 of the disable control unit 14 are joined at a node TRIG. The leakage-current generator 18 provides a leakage-current for the disable control unit 14. As such, the leakage-current charges stray capacitance (not shown) of the disable control unit 14 while the transistor M5 of the disable control unit 14 is in the cutoff mode.

As shown in FIG. 2, a drain terminal 16*d* of the transistor M6 of the trigger unit 16 is connected to a start-up terminal STU of the reference circuit unit 12. The transistor M6 of the trigger unit 16 is enabled while a voltage across stray capacitance (not shown) of the disable control unit 14 is more positive and greater than the threshold voltage at the node TRIG. In other words, with the voltage at the node TRIG established, the transistor M6 of the trigger unit 16 provides a path for a current to flow through the transistor M6 into the ground. As such, a start-up current $I_{STU}$ flows through the transistor M6 of the trigger unit 16, such that the reference circuit unit 12 is enabled to generate a reference current and provide the reference current for a next-stage circuit.

When the voltage at the control terminal CTRL of the reference circuit unit 12 is getting more positive and greater than the threshold voltage, the transistor M5 of the disable control unit 14 is on, as shown in FIG. 2. Accordingly, the leakage-current $I_{LC}$ flows through the transistor M5 of the disable control unit 14 into the ground. That is to say, when the voltage at the node TRIG has been pulled below the threshold voltage, the transistor M6 of the trigger unit 16 is in the cutoff mode. Therefore, the transistor M6 of the trigger unit 16 is disabled while the voltage at the node TRIG is below the threshold voltage. On this occasion, the start-up current $I_{STU}$ stops flowing through the transistor M6 of the trigger unit 16.

Upon the aforesaid operation, the leakage-current generated by the leakage-current generator 18 is able to start up the reference circuit unit 12 in order to generate a reference current for the next-stage circuit when used with relatively low supply voltages. Therefore, the resulting leakage-current start-up reference circuit 10 of the disclosure is power-saving, cost-effective, uncomplicated, highly versatile and effective, and can be implemented by adopting known semiconductor technology for efficient and economical manufacturing, application and utilization.

According to the exemplary embodiment of the disclosure, the leakage-current start-up reference circuit 10 generating a reference current is supply-voltage independent using the leakage-current technology.

Besides, the leakage-current start-up reference circuit 10 of the disclosure is capable of generating a reference current when used with relatively low supply voltages.

Figure 3:
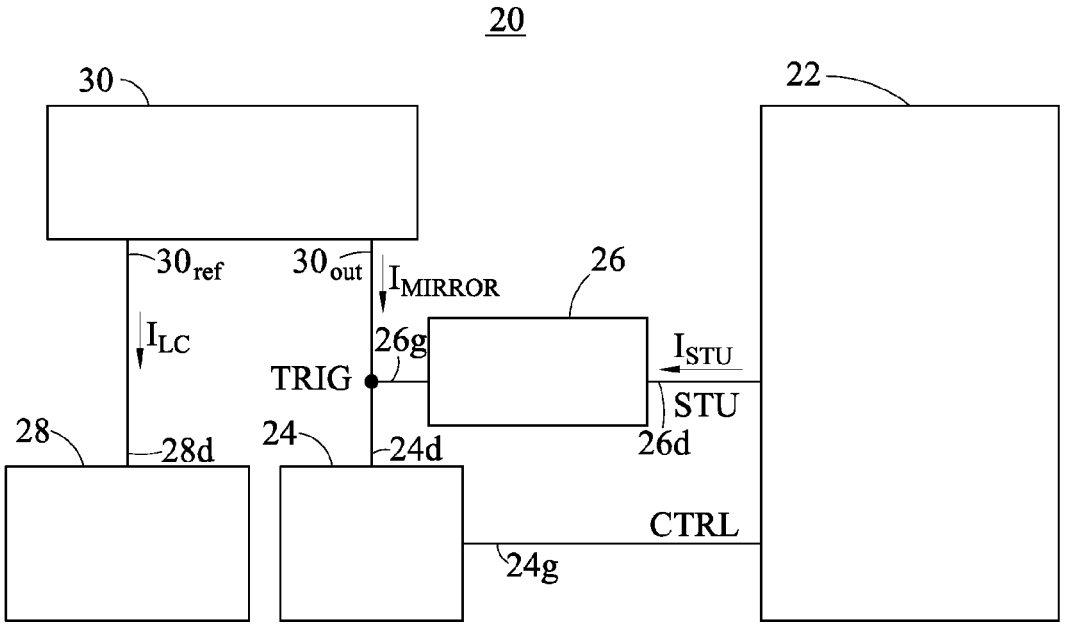
FIG. 3 is a block diagram illustrating a leakage-current start-up reference circuit in accordance with another exemplary embodiment of the disclosure.

FIG. 3 shows a block diagram of a leakage-current start-up reference circuit 20 in accordance with another exemplary embodiment of the disclosure. The leakage-current start-up reference circuit 20 may include a reference circuit unit 22, a disable control unit 24, a trigger unit 26, a leakage-current generator 28 and a current mirror 30.

According to another exemplary embodiment of the disclosure, the reference circuit unit 22 may have two terminals STU and CTRL. The current mirror 30 may have a reference terminal $\mathbf{30}_{ref}$ and an output terminal $\mathbf{30}_{out}$, as shown in FIG. 3. In another exemplary embodiment of the disclosure, the reference circuit unit 22 may be a reference voltage circuit, a reference current circuit, a bandgap reference circuit unit, a bias current circuit or the like.

As shown in FIG. 3, the reference circuit unit 22 is not started up in the beginning. The control terminal CTRL of the reference circuit unit 22 is connected to a gate terminal 24*g* of the disable control unit 24. The control terminal CTRL of the reference circuit unit 22 may provide a voltage below the threshold voltage for the gate terminal 24*g* of the disable control unit 24. When the gate terminal 24*g* of the disable control unit 24 is below the threshold voltage, the disable control unit 24 is off.

Moreover, as shown in FIG. 3, an output terminal $\mathbf{30}_{out}$ of the current mirror 30, a gate terminal 26*g* of the transistor M6 of the trigger unit 26 and a drain terminal 24*d* of the disable control unit 24 are joined at a node TRIG. In addition, a drain terminal 28*d* of the leakage-current generator 28 is coupled to the reference terminal $\mathbf{30}_{ref}$ of the current mirror 30. The leakage-current generator 28 provides a leakage-current for the current mirror 30. Subsequently, the current mirror 30 accepts the leakage-current at the reference terminal $\mathbf{30}_{ref}$, and provides a mirrored leakage-current $I_{MIRROR}$ at the output terminal $\mathbf{30}_{out}$. As such, the mirrored leakage-current $I_{MIRROR}$ charges stray capacitance (not shown) of the disable control unit 24 while the disable control unit 24 is in the cutoff mode.

Referring to FIG. 3, a drain terminal 26*d* of the trigger unit 26 is connected to a start-up terminal STU of the reference circuit unit 22. The trigger unit 26 is enabled while a voltage across stray capacitance (not shown) of the disable control unit 24 is more positive and greater than the threshold voltage at the node TRIG. In other words, with the voltage at the node TRIG established, the trigger unit 26 provides a path for a current to flow through the trigger unit 26 into the ground. As such, a start-up current $I_{STU}$ flows through the trigger unit 26, such that the reference circuit unit 22 is enabled to generate a reference current and provide the reference current for a next-stage circuit.

When the voltage at the control terminal CTRL of the reference circuit unit 22 is getting more positive and greater than the threshold voltage, the disable control unit 24 is turned on. Accordingly, the leakage-current $I_{LC}$ flows through the disable control unit 24 into the ground. That is to say, when the voltage at the node TRIG has been pulled below the threshold voltage, the trigger unit 26 is in the cutoff mode. Therefore, the trigger unit 26 is disabled while the voltage at the node TRIG is below the threshold voltage. On this occasion, the start-up current $I_{STU}$ stops flowing through the trigger unit 26.

According to another exemplary embodiment of the disclosure, the leakage-current generated by the leakage-current generator 28 is able to start up the reference circuit unit 22 in order to generate a reference current for the next-stage circuit when used with relatively low supply voltages. Therefore, the resulting leakage-current start-up reference circuit 20 of the disclosure is power-saving, cost-effective, uncomplicated, highly versatile and effective, and can be implemented by adopting known semiconductor technology for efficient and economical manufacturing, application and utilization.

In another exemplary embodiment of the disclosure, the leakage-current start-up reference circuit 20 generating a reference current is supply-voltage independent using the leakage-current technology.

Additionally, the leakage-current start-up reference circuit 20 of the disclosure is able to generate a reference current when used with relatively low supply voltages.

Figure 4:
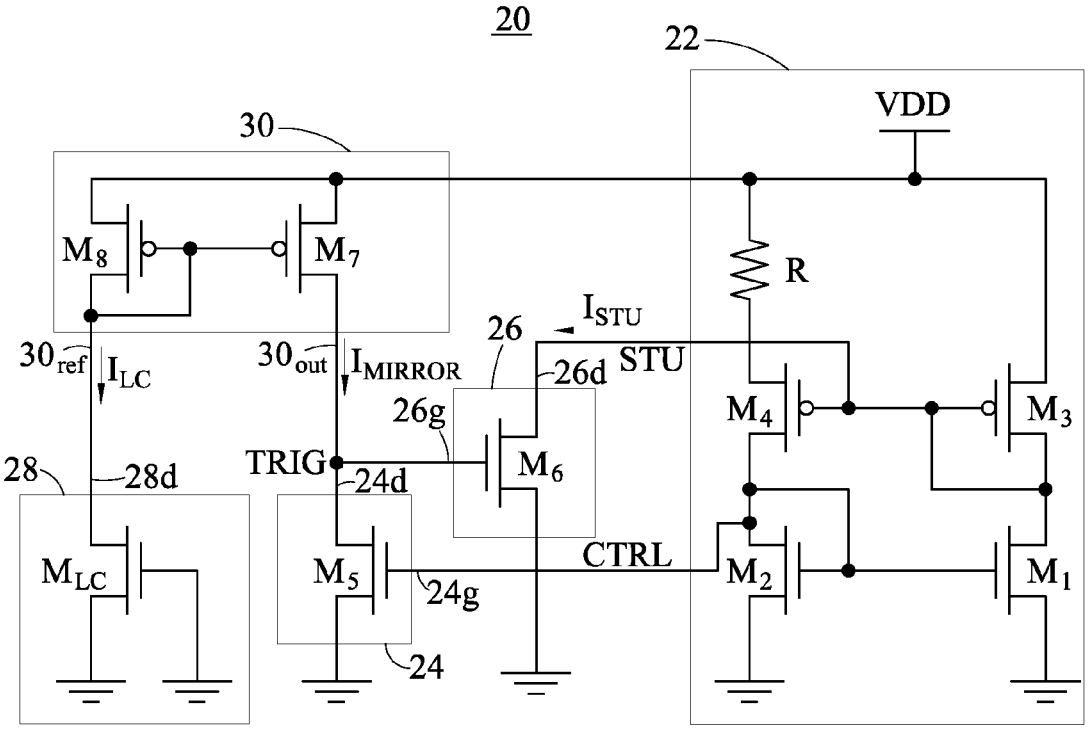
FIG. 4 is a circuit schematic diagram illustrating the leakage-current start-up reference circuit in accordance with another exemplary embodiment of the disclosure.

Referring to FIG. 4, a circuit schematic diagram of the leakage-current start-up reference circuit 20 is illustrated in accordance with another exemplary embodiment of the disclosure. The leakage-current start-up reference circuit 20 may include a reference circuit unit 22, a disable control unit 24, a trigger unit 26, a leakage-current generator 28 and a current mirror 30.

According to another exemplary embodiment of the disclosure, the reference circuit unit 22 having two terminals STU and CTRL may include a plurality of transistors M1, M2, M3, and M4. As shown in FIG. 4, the current mirror 30 having a reference terminal $\mathbf{30}_{ref}$ and an output terminal $\mathbf{30}_{out}$ may include a current-to-voltage converter consecutively connected to a voltage-to-current converter. It should be noted that the two converters may have a linear relationship. In another exemplary embodiment of the disclosure, the reference circuit unit 22 may be a reference voltage circuit, a reference current circuit, a bandgap reference circuit unit, a bias current circuit or the like.

In operation, as shown in FIG. 4, the trigger unit 26 may include a transistor M6. Moreover, the trigger unit may comprise digital electronics, such as digital NAND, NOR and NOT circuits. The leakage-current generator 28 may include a gate-drain-tied transistor $M_{LC}$. Also, the disable control unit 24 may include a transistor M5. As shown in FIG. 4, all the transistors used in the disclosure may be MOSFETs and the like.

As shown in FIG. 4, initially, the reference circuit unit 22 is not started up. The control terminal CTRL of the reference circuit unit 22 is connected to a gate terminal 24*g* of the transistor M5 of the disable control unit 24. The control terminal CTRL of the reference circuit unit 22 may provide a voltage below the threshold voltage for the gate terminal 24*g* of the transistor M5 of the disable control unit 24. When the gate terminal 24*g* of the disable control unit 24 is below the threshold voltage for making a conductive channel, there is little or no conduction between the drain and source terminals; that is, the disable control unit 24 is off.

Moreover, as shown in FIG. 4, an output terminal $\mathbf{30}_{out}$ of the current mirror 30, a gate terminal 26*g* of the transistor M6 of the trigger unit 26 and a drain terminal 24*d* of the transistor M5 of the disable control unit 24 are joined at a node TRIG. A drain terminal 28*d* of the gate-drain-tied transistor $M_{LC}$ of the leakage-current generator 28 is coupled to the reference terminal $\mathbf{30}_{ref}$ of the current mirror 30. The leakage-current generator 28 provides a leakage-current for the current mirror 30. Subsequently, the current mirror 30 accepts the leakage-current at the reference terminal $\mathbf{30}_{ref}$, and provides a mirrored leakage-current $I_{MIRROR}$ at the output terminal $\mathbf{30}_{out}$. As such, the mirrored leakage-current $I_{MIRROR}$ charges stray capacitance (not shown) of the disable control unit 24 while the transistor M5 of the disable control unit 24 is in the cutoff mode.

Referring to FIG. 4, a drain terminal 26*d* of the transistor M6 of the trigger unit 26 is connected to a start-up terminal STU of the reference circuit unit 22. The transistor M6 of the trigger unit 26 is enabled while a voltage across stray capacitance (not shown) of the disable control unit 24 is more positive and greater than the threshold voltage at the node TRIG. In other words, with the voltage at the node TRIG established, the transistor M6 of the trigger unit 26 provides a path for a current to flow through the transistor M6 into the ground. As such, a start-up current $I_{STU}$ flows through the transistor M6 of the trigger unit 26, such that the reference circuit unit 22 is enabled to generate a reference current and provide the reference current for a next-stage circuit.

When the voltage at the control terminal CTRL of the reference circuit unit 22 is getting more positive and greater than the threshold voltage, the transistor M5 of the disable control unit 24 is on. Accordingly, the leakage-current $L_{LC}$ flows through the transistor M5 of the disable control unit 24 into the ground. That is to say, when the voltage at the node TRIG has been pulled below the threshold voltage, the transistor M6 of the trigger unit 26 is in the cutoff mode. Therefore, the transistor M6 of the trigger unit 26 is disabled while the voltage at the node TRIG is below the threshold voltage. On this occasion, the start-up current $I_{STU}$ stops flowing through the transistor M6 of the trigger unit 26.

In another exemplary embodiment of the disclosure, the leakage-current generated by the leakage-current generator 28 is able to start up the reference circuit unit 22 in order to generate a reference current for the next-stage circuit when used with relatively low supply voltages. Therefore, the resulting leakage-current start-up reference circuit 20 of the disclosure is power-saving, cost-effective, uncomplicated, highly versatile and effective, and can be implemented by adopting known semiconductor technology for efficient and economical manufacturing, application and utilization. It valuably supports and services the trend of reducing power and costs, simplifying systems and increasing performance.

According to another exemplary embodiment of the disclosure, the leakage-current start-up reference circuit 20 generating a reference current is supply-voltage independent using the leakage-current technology.

Furthermore, the leakage-current start-up reference circuit 20 of the disclosure is capable of generating a reference current when used with relatively low supply voltages.

Figure 5:
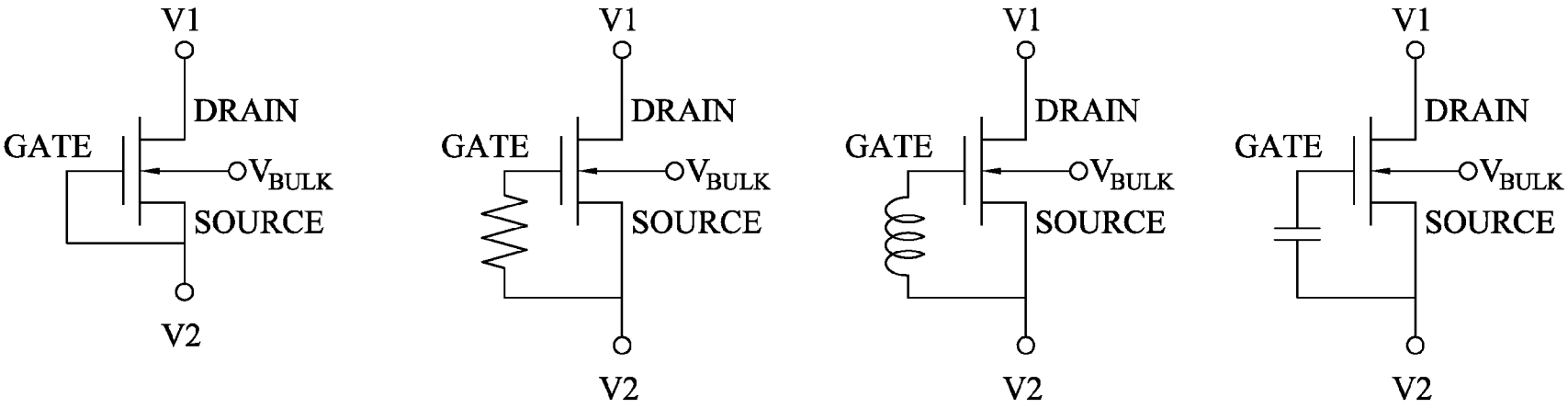
FIG. 5 is a circuit schematic diagram illustrating different types of the leakage-current generator in accordance with the embodiments of the disclosure.

As shown in FIG. 5, different types of the leakage-current generator 18, 28 of the disclosure are illustrated. For example, a resistor, inductor or capacitor may be connected between the gate and source terminals of the transistor $M_{LC}$.

According to the disclosure, the above embodiments are only used to exemplify the leakage-current circuit using the leakage-current technique, and should not be construed as to limit the disclosure. As such, the embodiments of the disclosure can be modified and altered by those with ordinary skill in the art, without departing from the spirit and scope of the disclosure as defined in the following appended claims.

While the disclosure has been described in conjunction with a specific best mode, it should be understood that many alternatives, modifications, and variations will be apparent to those skilled in the art in light of the aforesaid description. Accordingly, it is intended to embrace all such alternatives, modifications, and variations that fall within the scope of the included claims. All matters heretofore set forth herein or shown in the accompanying drawings are to be interpreted in an illustrative and non-limiting sense.

What is claimed is:

1. A leakage-current start-up reference circuit comprising:

a reference circuit unit having a start-up terminal and a control terminal and generating a reference current;

a trigger unit comprising a first transistor with source, gate and drain terminals, the drain terminal of the trigger unit being connected to the start-up terminal of the reference circuit unit, wherein the trigger unit starts up the reference circuit unit through the start-up terminal;

a leakage-current generator comprising a second transistor with a drain terminal, the second transistor being a gate-drain-tied transistor; and a disable control unit comprising a third transistor with source, gate and drain terminals, the drain terminal of the leakage-current generator, the gate terminal of the trigger unit and the drain terminal of the disable control unit being joined at a node, and the gate terminal of the disable control unit being connected to the control terminal of the reference circuit unit, wherein the leakage-current generator provides a leakage-current for the disable control unit.

2. The leakage-current start-up reference circuit of claim 1, wherein the reference circuit unit is a reference voltage circuit, a reference current circuit, a bandgap reference circuit unit or a bias current circuit.

3. The leakage-current start-up reference circuit of claim 1, wherein the first transistor and third transistor are P-type transistors while the second transistor is an N-type transistor, or the first transistor and third transistor are N-type transistors while the second transistor is a P-type transistor.

4. The leakage-current start-up reference circuit of claim 1, wherein the first, second and third transistor are MOSFETs.

5. The leakage-current start-up reference circuit of claim 1, wherein a resistor, inductor or capacitor is connected between the gate and source terminals of the second transistor.

6. The leakage-current start-up reference circuit of claim 1, wherein the leakage-current charges stray capacitance of the disable control unit while the third transistor of the disable control unit is in a cutoff mode.

7. The leakage-current start-up reference circuit of claim 6, wherein a start-up current flows through the first transistor, such that the reference circuit unit is started up to provide the reference circuit unit for a next-stage circuit.

8. The leakage-current start-up reference circuit of claim 6, wherein the disable control unit is turned on by the control terminal of the reference circuit unit, and the trigger unit is turned off after the reference circuit unit is started up.

9. The leakage-current start-up reference circuit of claim 1, wherein the trigger unit comprises digital electronics.

10. A leakage-current start-up reference circuit comprising:

a reference circuit unit having a start-up terminal and a control terminal and generating a reference current;

a trigger unit comprising a first transistor with source, gate and drain terminals, the drain terminal of the trigger unit being connected to the start-up terminal of the reference circuit unit, wherein the trigger unit starts up the reference circuit unit through the start-up terminal;

a leakage-current generator comprising a second transistor with a drain terminal, the second transistor being a gate-drain-tied transistor;

a disable control unit comprising a third transistor with source, gate and drain terminals, the gate terminal of the disable control unit being connected to the control terminal of the reference circuit unit; and a current mirror having a reference terminal and an output terminal, the reference terminal being connected to the drain terminal of the leakage-current generator, and the output terminal, the gate terminal of the trigger unit and the drain terminal of the disable control unit being joined at a node, wherein the leakage-current generator provides a leakage-current for the current mirror.

11. The leakage-current start-up reference circuit of claim 10, wherein the reference circuit unit is a reference voltage circuit, a reference current circuit, a bandgap reference circuit unit or a bias current circuit.

12. The leakage-current start-up reference circuit of claim 10, wherein the first transistor and third transistor are P-type transistors while the second transistor is an N-type transistor, or the first transistor and third transistor are N-type transistors while the second transistor is a P-type transistor.

13. The leakage-current start-up reference circuit of claim 10, wherein the first, second and third transistor are MOSFETs.

14. The leakage-current start-up reference circuit of claim 10, wherein a resistor, inductor or capacitor is connected between the gate and source terminals of the second transistor.

15. The leakage-current start-up reference circuit of claim 10, wherein a mirrored leakage-current generated by the current mirror charges stray capacitance of the disable control unit while the third transistor of the disable control unit is in a cutoff mode.

16. The leakage-current start-up reference circuit of claim 15, wherein a start-up current flows through the first transistor, such that the reference circuit unit is started up to provide the reference circuit unit for a next-stage circuit.

17. The leakage-current start-up reference circuit of claim 15, wherein the disable control unit is turned on by the control terminal of the reference circuit unit, and the trigger unit is turned off after the reference circuit unit is started up.

18. The leakage-current start-up reference circuit of claim 10, wherein the trigger unit comprises digital electronics.

* * * * *